US008272144B2

(12) United States Patent
Arreghini

(10) Patent No.: US 8,272,144 B2
(45) Date of Patent: Sep. 25, 2012

(54) ELECTRIC HOUSEHOLD APPLIANCE

(75) Inventor: Luigi Arreghini, Portogruaro (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 237 days.

(21) Appl. No.: 12/593,950

(22) PCT Filed: May 13, 2008

(86) PCT No.: PCT/EP2008/003811

§ 371 (c)(1),
(2), (4) Date: Sep. 30, 2009

(87) PCT Pub. No.: WO2008/141750

PCT Pub. Date: Nov. 27, 2008

(65) Prior Publication Data

US 2010/0115790 A1 May 13, 2010

(30) Foreign Application Priority Data

May 21, 2007 (EP) ..... 07108567

(51) Int. Cl.
*F26B 21/06* (2006.01)
*D06F 58/04* (2006.01)

(52) U.S. Cl. ..... 34/570; 34/571; 34/140; 34/90

(58) Field of Classification Search ..... 34/524, 34/570, 571, 595, 602, 140, 90
See application file for complete search history.

(56) References Cited

U.S. PATENT DOCUMENTS

| | | | | |
|---|---|---|---|---|
| 2,873,539 | A | 2/1959 | Morey | |
| 3,106,831 | A * | 10/1963 | Behrens | 68/12.08 |
| 3,544,207 | A * | 12/1970 | John, Jr. | 352/109 |
| 2005/0241326 | A1 * | 11/2005 | Yoong et al. | 62/186 |
| 2006/0117596 | A1 * | 6/2006 | Kim et al. | 34/607 |
| 2007/0006484 | A1 | 1/2007 | Moschuetz et al. | |

FOREIGN PATENT DOCUMENTS

| | | | |
|---|---|---|---|
| EP | 1 441 058 | | 7/2004 |
| EP | 1 441 060 | | 7/2004 |
| EP | 1 666 655 | | 6/2006 |
| GB | 2 143 935 | | 2/1985 |
| GB | 2 346 678 | | 8/2000 |
| JP | 01029295 | A * | 1/1989 |
| WO | 2006101358 | | 9/2006 |

OTHER PUBLICATIONS

International Search Report and Written Opinion for corresponding PCT/EP2008/003811, mailed Jul. 8, 2008.

* cited by examiner

*Primary Examiner* — Jiping Lu
(74) *Attorney, Agent, or Firm* — Banner & Witcoff, Ltd

(57) ABSTRACT

An electric household appliance (1) having a casing (2); a rotary drum (3) housing laundry to be dried and mounted for rotation about its longitudinal axis (L) inside the casing (2); a door (4) which rotates to and from a work position closing an opening (2*a*) in the casing (2) to close the drum (3); a hot-air generator (5) for circulating hot air inside the drum (3); a steam generator (15) for circulating a steam jet inside the drum (3); an exhaust manifold (11) communicating with the drum (3) to allow outflow of air/steam from the drum (3); and a shutter device (30) for selectively opening/closing the exhaust manifold (11) to permit /prevent free outflow of air/steam from the drum (3).

14 Claims, 7 Drawing Sheets

ELECTRIC HOUSEHOLD APPLIANCE

BACKGROUND OF THE INVENTION

The present invention relates to an electric household appliance.

More specifically, the present invention relates to an electric household appliance corresponding to a rotary-drum home washing machine or laundry drier, to which the following description refers purely by way of example.

As is known, rotary-drum laundry driers substantially comprise a substantially parallelepiped-shaped casing; a cylindrical laundry drying tub or chamber fixed horizontally inside the casing, directly facing a laundry loading/unloading opening formed, in the front face of the casing; a door hinged to the front face of the casing to rotate to and from a work position closing the opening in the front face and sealing the drying tub; a cylindrical, perforated-wall laundry drum housed in axially rotating manner inside the wash/drying tub; and an electric motor for rotating the laundry drum about its longitudinal axis inside the drying tub.

Rotary-drum driers of the above type also comprise a hot-air generator for circulating inside the drying tub hot, dry air, which flows through the laundry drum and over the laundry inside to dry the laundry rapidly.

More specifically, some so-called "vented driers" feature an open-circuit, hot-air generator, which comprises an intake manifold connecting the rear wall of the drying tub to an air inlet; and an air exhaust manifold connected at one end to the front wall of the drying tub, and at the other end to an air exhaust outlet at the front of the casing.

The open-circuit, hot-air generator also comprises an electric heating element located along the intake manifold to heat the air before it is fed into the drying tub; and a ventilation device located along the exhaust manifold to draw air along the intake manifold, feed the hot air through the drying tub, and expel the moist air through the exhaust manifold.

The ventilation device is defined by a fan located along the exhaust manifold; and by a drive interposed between the drum electric motor and the fan to rotate the fan.

Using the same electric motor to simultaneously rotate the air intake/exhaust fan and the drum, as opposed to a specific electric motor for each device, has the major advantage of reducing the manufacturing cost of the drier.

On the other hand, in driers, with open-circuit, hot-air generators, the above solution makes it difficult to also implement a crease-removing function for which there is strong market demand, and which provides for feeding a jet of steam into the drying tub to eliminate or at any rate greatly reduce creasing of the fabrics during the drying cycle, and so make the fabrics easier to iron.

More specifically, whereas, when feeding the steam into the drying tub, the drying tub must be rotated to loosen and partly eliminate creasing of the fabrics inside the drum, operating the ventilation device simultaneously with rotation of the drying tub has the major drawback of practically expelling the steam immediately from the tub, thus reducing the crease-removing effectiveness of the steam. In other words, effective crease removal is prevented by the ventilation device immediately and continuously exhausting the steam.

SUMMARY OF SELECTED INVENTIVE ASPECTS

It is an object of the present invention to provide an electric household appliance, in particular a home laundry drier, which, on the one hand, maintains the advantages of known driers with an open-circuit, hot-air generator, by employing a single electric motor to rotate both the fan along the exhaust manifold, and the laundry drum, and which, on the other hand, provides for feeding steam correctly, i.e. with no immediate exhaust of the steam, into the drying tub, i.e. the laundry drum.

According to the present invention, there is provided an electric household appliance as claimed in claim 1 and preferably, though not necessarily, in any one of the claims depending directly or indirectly on claim 1.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 1:
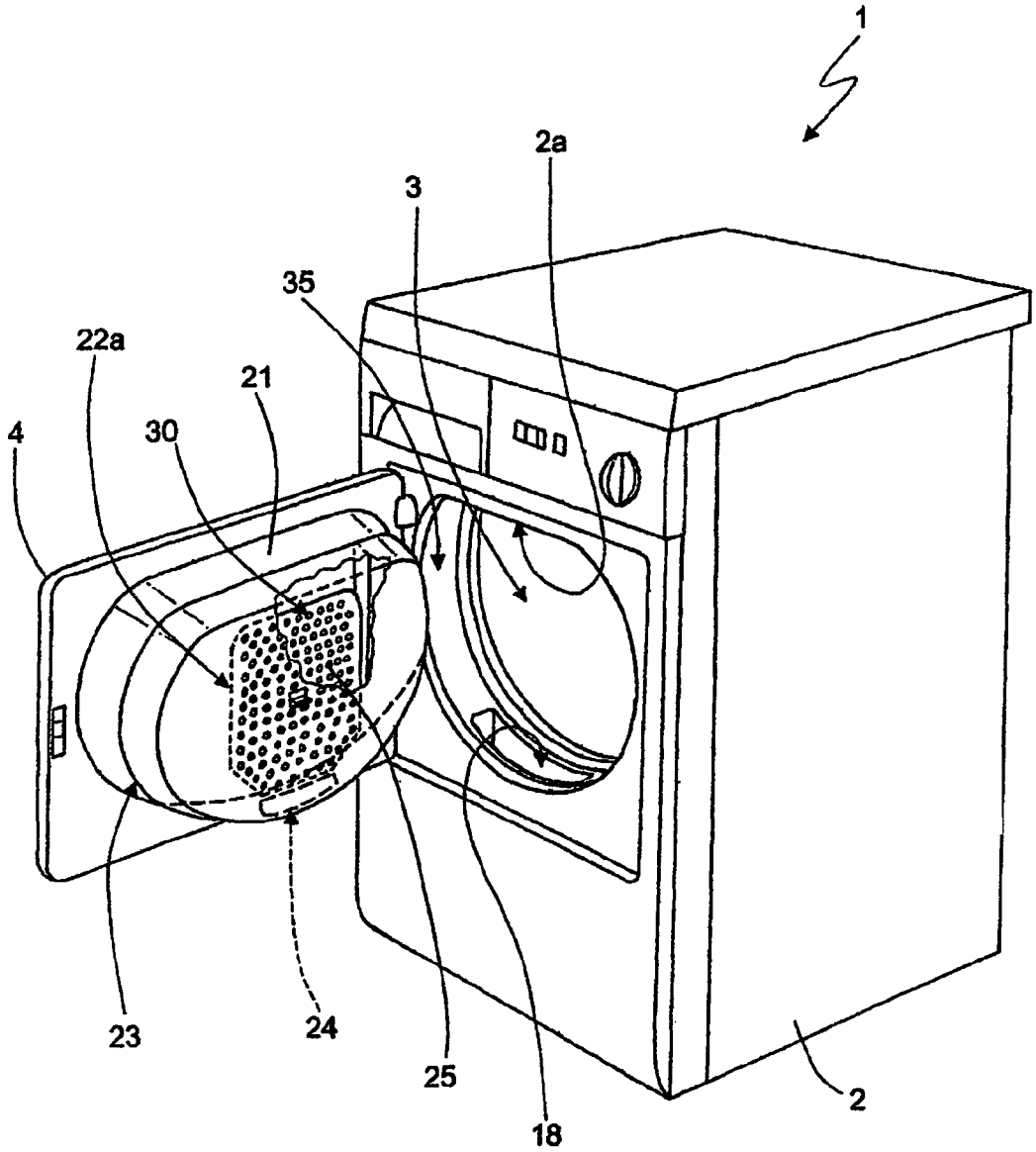
FIG. 1 shows a view in perspective of an electric household appliance, in particular a rotary-drum laundry drier, in accordance with the teachings of the present invention.
Figure 2:
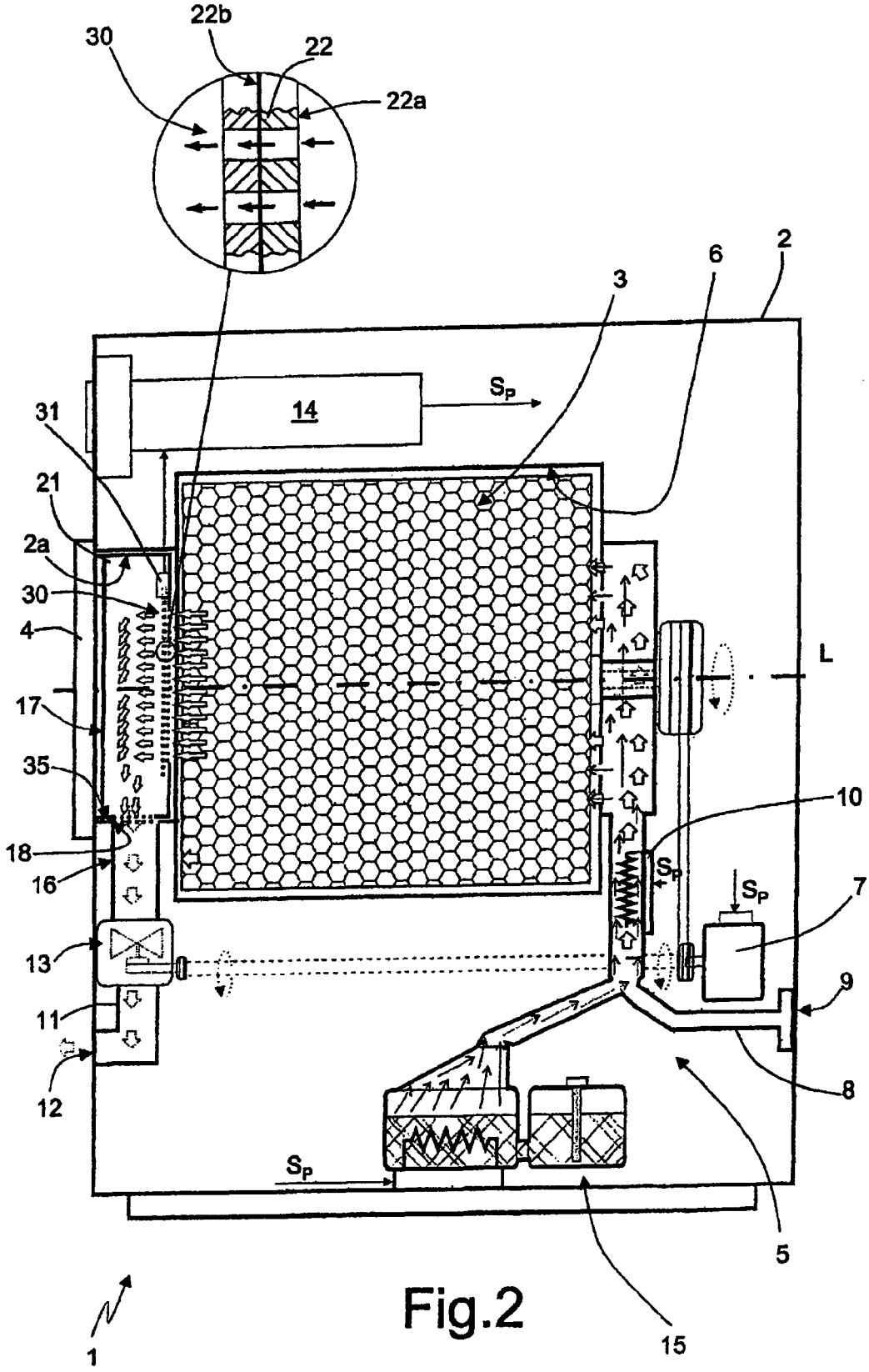
FIGS. 2 and 3 show two schematic side views of the Figure rotary-drum drier, showing shutter means in two different operating positions.

With reference to FIGS. 1 and 2, number 1 indicates as a whole an electric household appliance, in particular a home laundry drier, substantially comprising a preferably, though not necessarily, parallelepiped-shaped casing 2; a drum 3 for housing the laundry to be dried, and which is housed in axially rotating manner and preferably, though not necessarily, horizontally inside casing 2, directly facing a laundry loading/unloading opening 2*a* formed in the front face of casing 2; a door 4 hinged to the front face of casing 2 to rotate to and from a work position closing opening 2*a* in the front face and sealing drum 3; and an open-circuit, hot-air generator 5 housed inside casing 2 to circulate hot, dry air inside drum 3 and over the laundry inside the drum to dry the laundry rapidly.

Drier 1 also comprises an electric motor 7 or similar for rotating drum 3 about its longitudinal axis L, preferably, though not necessarily, inside a drying tub 6 housed inside casing 2. In the FIG. 1 example, longitudinal axis L coincides with the longitudinal axis of drying tub 6.

With reference to FIG. 2, open-circuit, hot-air generator 5 provides for gradually drawing in air from outside drum 3; heating the drawn-in air to a predetermined temperature; and drawing the damp air out of drum 3.

In other words, hot-air generator 5 provides for continually drawing in outside air, heating and feeding it into drum 3 to rapidly dry the laundry inside the drum, and exhausting the damp air from drum 3.

Hot-air generator 5 substantially comprises: an air intake manifold 8 having a first end connected to the rear wall of drum 3, and a second end connected to an air inlet 9 formed preferably, though not necessarily, in casing 2; an electric heating element 10 (in the example shown, a resistor) located along intake manifold 8 to rapidly heat the airflow through inlet 9; an exhaust manifold 11 having a first end connected preferably, though not necessarily, to the front wall of drum 3, and a second end connected to an exhaust outlet 12 preferably, though not necessarily, in the front face of casing 2; and a centrifugal fan 13 located along exhaust manifold 11 to produce, inside intake manifold 8 and exhaust manifold 11, an airflow, which flows through drum 3 and over the laundry inside the drum, and is exhausted to the outside.

Centrifugal fan 13 is connected by a drive mechanism (shown by the dash line) to electric motor 7, which rotates both fan 13 and drum 3 about respective axes of rotation as a function of control signals $S_p$ generated by a control unit 14 during a user-selected drying cycle.

Drier 1 also comprises a steam generator 15, which, as a function of control signals $S_p$ generated by control unit 14, feeds a steam jet into drum 3 to eliminate or at any rate greatly reduce creasing of the fabrics during the drying cycle.

Casing 2, drying tub 6, drum 3, electric motor 7, and steam generator 15 are commonly used parts in the industry and therefore not described in detail.

With reference to FIG. 2, exhaust manifold 11 comprises a first manifold portion 16 extending inside casing 2; and a second manifold portion 17 fixed stably to door 4 and designed to connect to first portion 16, when door 4 closes opening 2*a*, to connect first portion 16 to drum 3.

Figure 3:
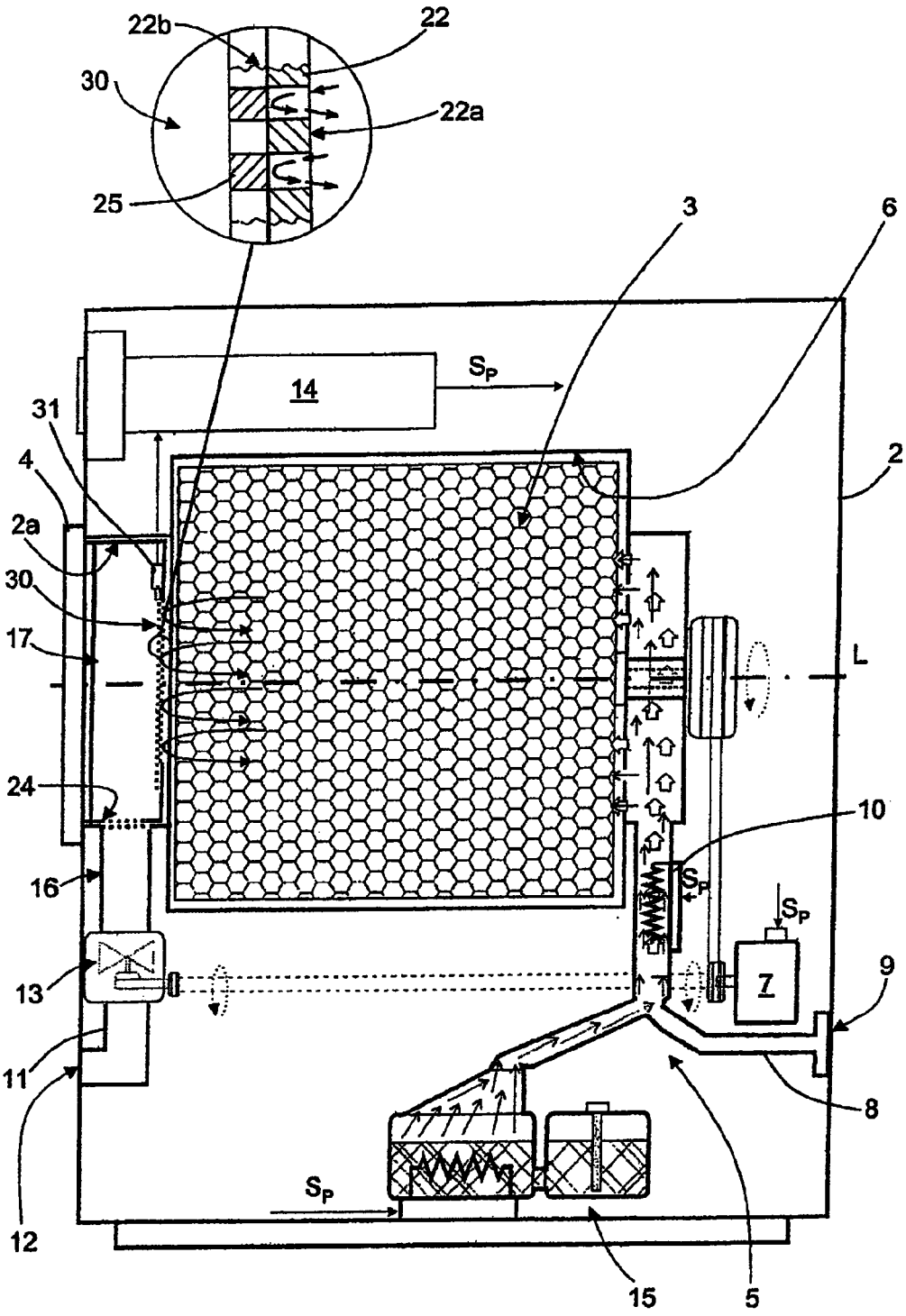

In the FIGS. 2 and 3 example, first manifold portion 16 preferably, though not necessarily, extends inside the front wall of casing 2, and has one end, i.e. its outlet, connected to exhaust outlet 12, and the opposite end, i.e. its inlet, connected to an opening 18 formed in an annular portion 35 of casing 2 defining the peripheral edge of opening 2*a* of drier 1 for housing door 4.

More specifically, centrifugal fan 13 is located along first manifold portion 16, downstream from second portion 17 along the air/steam flow path from drum 3 to exhaust outlet 12.

Second portion 17 of exhaust manifold 11 is defined by a substantially cylindrical box member or shell 21, which projects from the inner face of door 4, extends through opening 2*a*, and projects partly inside drum 3.

More specifically, with reference to FIGS. 1, 2 and 3, shell 21 comprises a front wall 22 positioned facing drum 3 when door 4 closes opening 2*a*, and in turn comprising a perforated central portion 22*a* through which the air/steam in drum 3 flows to the inlet of exhaust manifold 11.

More specifically, the lateral wall 23 of shell 21 has a slit 24 which, when door 4 closes opening 2*a*, is positioned facing opening 18 to connect second manifold portion 17 to the inlet of first manifold portion 16, and so allow the air/steam flowing along second portion 17 to flow freely into first portion 16 and out to the outside.

Unlike known open-circuit, hot-air generators, open-circuit, hot-air generator 5 of drier 1 comprises shutter means 30 for selectively opening/closing exhaust manifold 11 (FIGS. 2, 3) to allow/prevent free outflow of the air/steam from drum 3.

In other words, shutter means 30 selectively close exhaust manifold 11 at the crease-removing stage to prevent the steam inside drum 3 from flowing freely along exhaust manifold 11 to the outside (FIG. 3).

More specifically, in the example shown in FIGS. 1, 2, 3, 4, 5, shutter means 30 comprise a shutter plate 25 mounted on the inner surface 22*b* of front wall 22 to move between an open position (shown schematically in FIG. 2)—in which the air/steam in drum 3 flows freely through perforated portion 22*a* of front wall 22 into exhaust manifold 11—and a closed position (shown schematically in FIG. 3)—in which the holes in central perforated portion 22*a* are closed completely to prevent the air/steam in drum 3 from flowing freely to the outside along exhaust manifold 11.

In the FIG. 2 example, shutter plate 25 is fitted movably to inner surface 22*b* of front wall 22, and is defined by a plate having a number of central holes which, when shutter plate 25 is in the open position, are aligned with the holes in perforated portion 22*a* of front wall 22.

Conversely, when shutter plate 25 is in the closed position (FIG. 3), the holes in the shutter plate are offset with respect to, and so close, the holes in perforated portion 22*a* of front wall 22.

Figure 4:
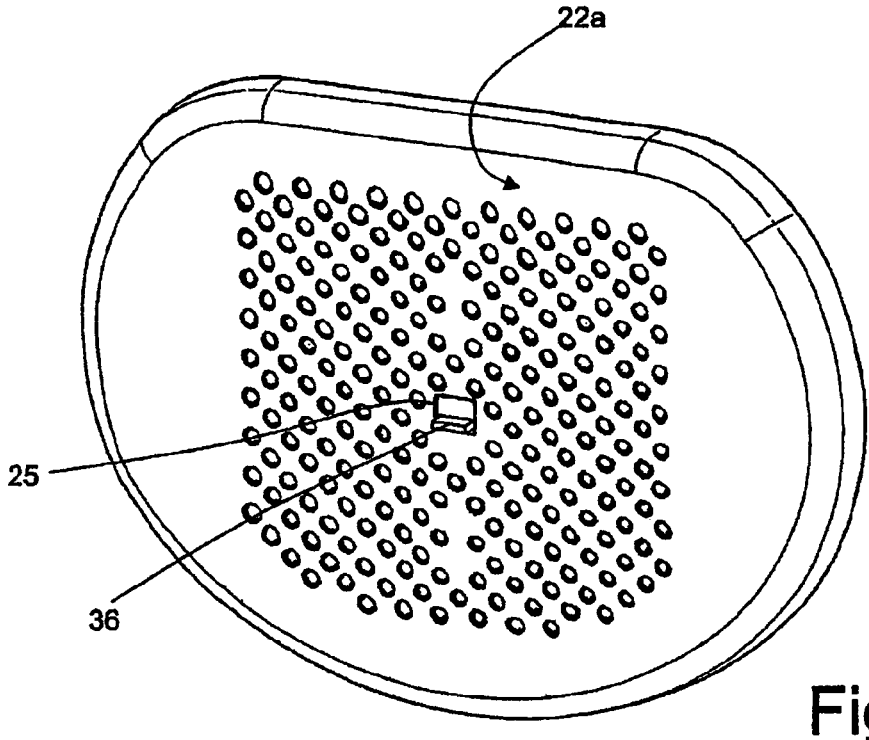
FIGS. 4 and 5 show details of the shutter means fitted to the door of the FIG. 1 rotary-drum drier.
Figure 5:
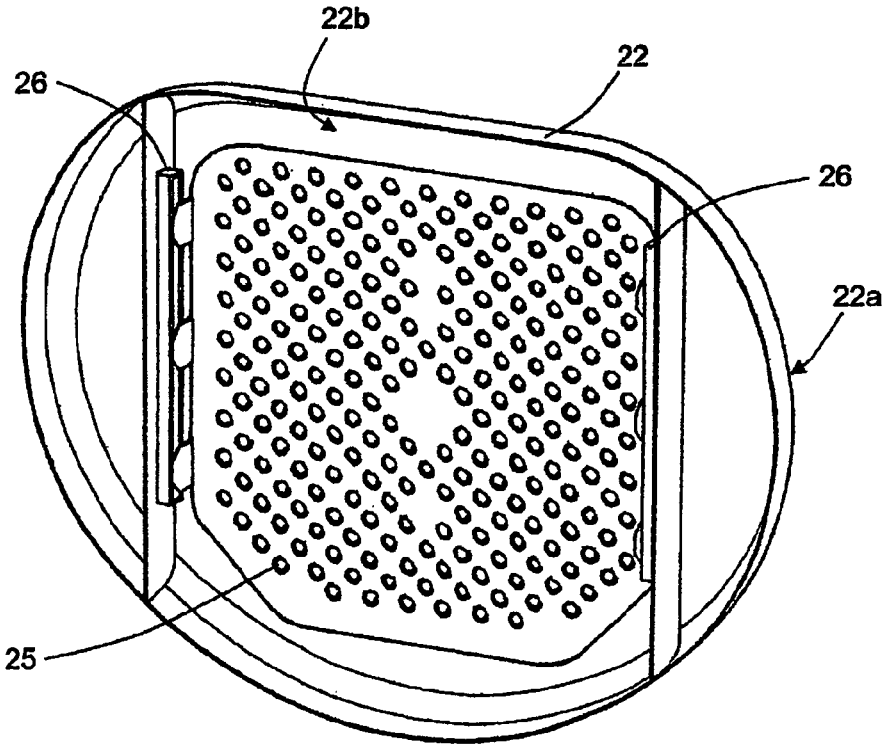

In the FIGS. 4 and 5 example, shutter plate 25 is mounted to slide along two lateral rails 26 on the inner surface of front wall 22, and has a central operating tab 36 projecting towards drum 3 through a slot formed through front wall 22, to allow the user to move shutter plate 25 manually between the open and closed position.

In the example shown, to activate the crease-removing function, the user moves shutter plate 25 manually from the open to the closed position using tab 36, thus closing exhaust manifold 11 and so preventing steam exhaust from drum 3 by centrifugal fan 13 (FIG. 3), which nevertheless remains operative.

Conversely, to activate the drying function, the user moves shutter plate 25 manually from the closed to the open position (FIG. 2), thus opening exhaust manifold 11, so that the damp air is exhausted completely from drum 3 by centrifugal fan 13.

Figure 6:
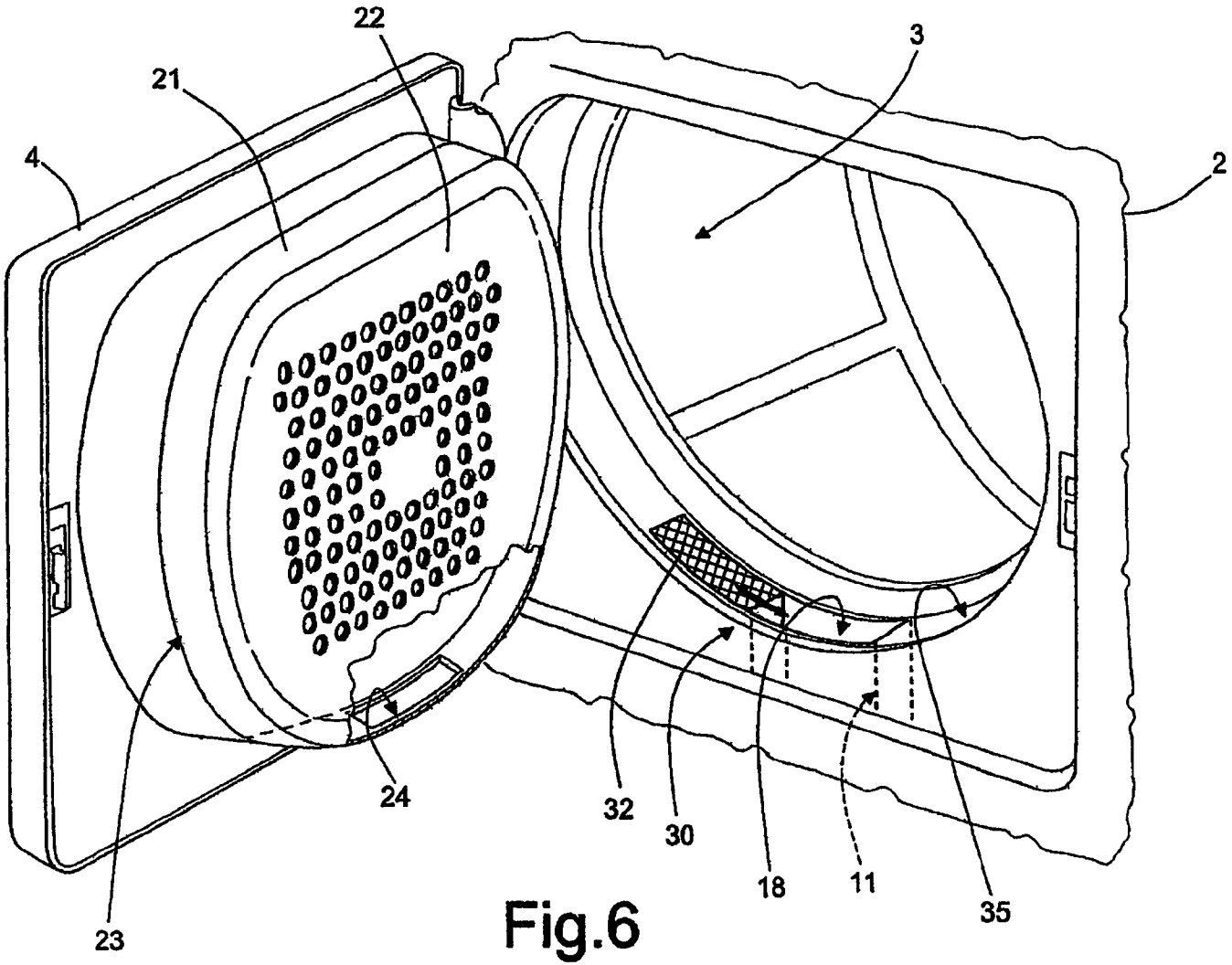
FIG. 6 shows a view in perspective of a first variation of the shutter means of the FIG. 1 rotary-drum drier.
Figure 7:
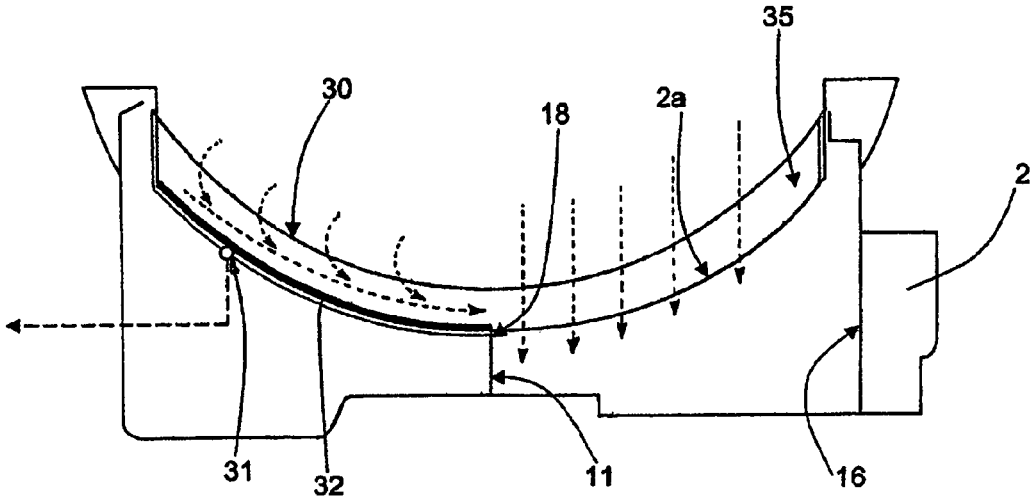
FIGS. 7 and 8 show schematic side views of the FIG. 6 shutter means in two different operating positions.
Figure 8:
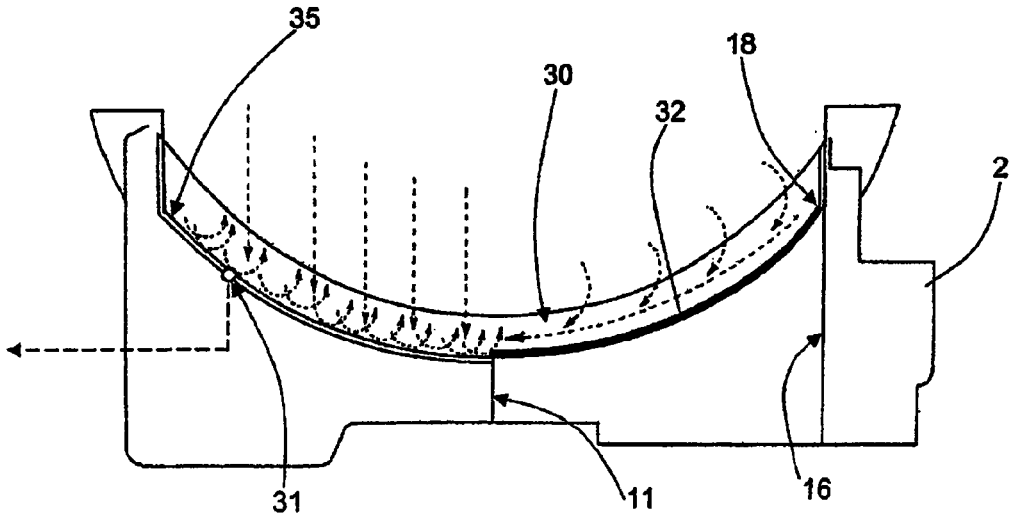

In a first variation shown in FIGS. 6, 7 and 8, shutter means 30 comprise a flap 32 fitted, at opening 18, to annular portion 35 of casing 2 defining the inner peripheral edge of opening 2*a* of drier 1, and which slides between an open position (shown schematically in FIGS. 6, 7) allowing free air/steam flow from drum 3 to exhaust manifold 11, and a closed position (shown schematically in FIG. 8) closing opening 18 to prevent air/steam flow from drum 3 to exhaust manifold 11.

More specifically, in the closed position, flap 32 seals opening 18 to prevent free air/steam flow from second portion 17 to first portion 16; whereas, in the open position, flap 32 is shifted to the side of opening 18 to fully open and connect opening 18 to slit 24 in shell 21, and so allow free air/steam flow from second portion 17 to first portion 16 of the exhaust manifold.

Figure 9:
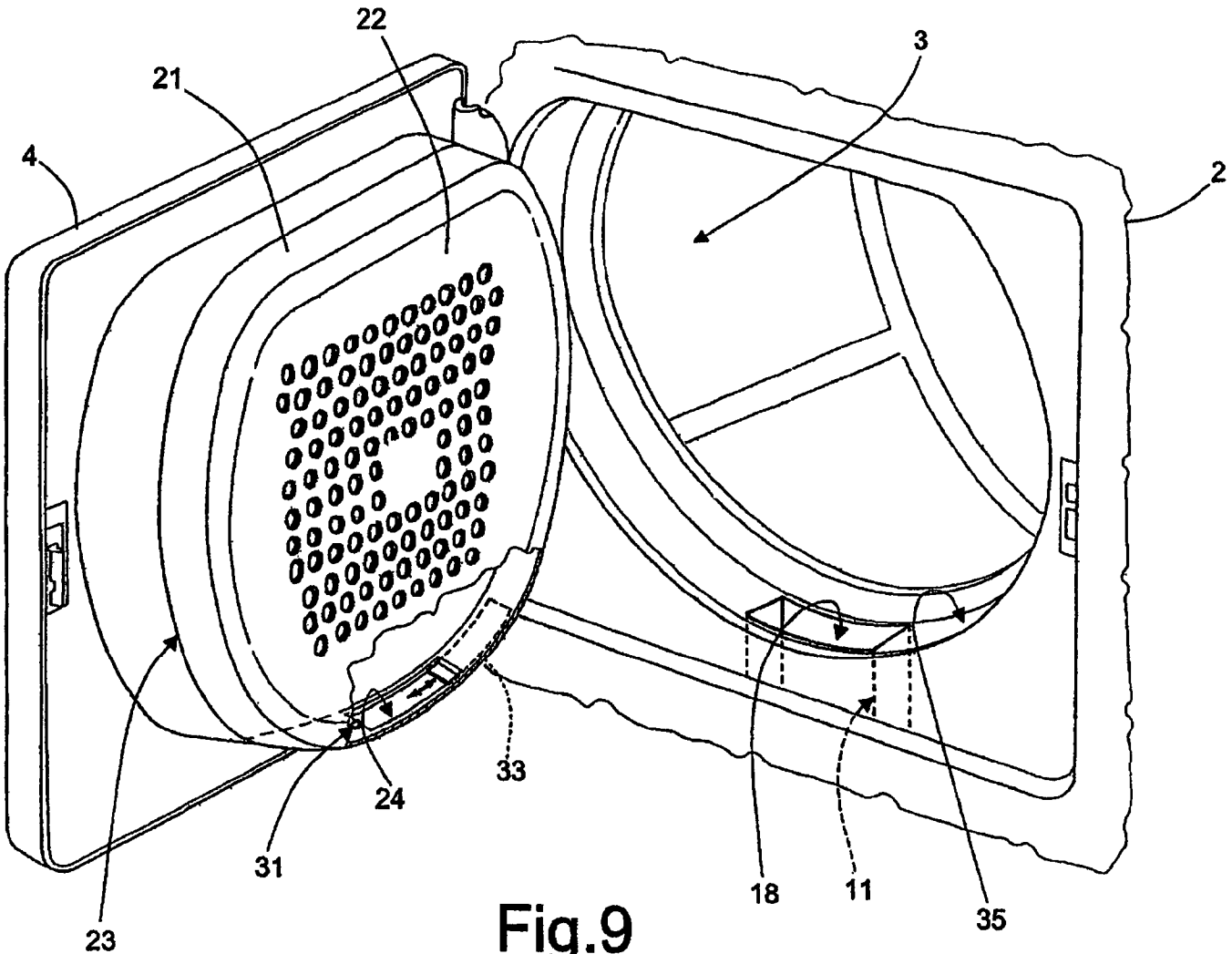
FIG. 9 shows a view in perspective of a second variation of the shutter means of the FIG. 1 drier.

In a second variation shown in FIG. 9, shutter means 30 comprise a flap 33 fitted, at slit 24, to lateral wall 23 of shell 21, and which slides between an open position opening slit 24 and allowing free air/steam flow from drum 3 to exhaust manifold 11, and a closed position closing slit 24 to prevent air/steam flow from drum 3 to first portion 16 of exhaust manifold 11.

More specifically, in the closed position, flap 33 seals slit 24; whereas, in the open position, flap 33 is positioned, on lateral wall 23 of shell 21, to the side of slit 24 to fully open and connect slit 24 to opening 18 in annular portion 35 of casing 2.

To simplify user operation, and prevent misuse, of shutter means 30, hot-air generator 5 may comprise a sensor 31 (FIGS. 2, 3, 7, 8) for determining the open/closed position of shutter means 30, and which, on detecting a closed position of shutter means 30, prevents control unit 14 from activating a drying cycle, and conversely, on detecting an open position of shutter means 30, prevents control unit 14 from activating a crease-removing cycle.

In the example shown, sensor 31 may conveniently comprise a microswitch, which switches from one on/off state to the other when shutter means 30 are set to the open or closed position.

In the FIGS. 2 and 3 example, sensor 31 is located on wall 22 of shell 21, and is switched by shutter plate 25 moving into a given open/closed position.

In the FIGS. 7 and 8 example, sensor 31 is located on annular portion 35, and is switched by flap 32 moving into a given open/closed position; and, in the FIG. 9 example, sensor 31 is located on lateral wall 23 of shell 21, and is switched by flap 33 moving into a given open/closed position. Sensor 31 may obviously also be located directly on flap 33 or in any other position in which it is switched by a change in position of flap 33.

To activate the drying function, the user sets shutter means to the open position opening exhaust manifold 11, and activates a drying cycle using selector means (not shown). At which point, by means of sensor 31, control unit 14 determines whether or not shutter means 30 are in the open position, and, if they are not, disables the user-set drying cycle.

Conversely, on determining shutter means 30 are in the open position, control unit 14 activates hot-air generator 5 and, simultaneously, electric motor 7, which rotates drum 3 and centrifugal fan 13, which expels the damp air along the, in this case, fully open exhaust manifold 11.

To activate the crease-removing function, the user sets shutter means 30 to the closed position closing exhaust manifold 11, and activates a crease-removing cycle using selector means (not shown).

At which point, by means of sensor 31, control unit 14 determines whether or not shutter means 30 are in the closed position, and, if they are not, disables the user-set crease-removing cycle.

Conversely, on determining shutter means 30 are in the closed position, control unit 14 activates steam generator 15 and, simultaneously, electric motor 7, which rotates both drum 3 and centrifugal fan 13, which, in this case, expels no steam from the drying tub, by virtue of exhaust manifold 11 being closed.

The drier described has the major advantage of employing a single electric motor for driving both the ventilation device and the laundry drum, thus maintaining the cost-saving advantages of known driers with an open-circuit, hot-air generator, while at the same time implementing the crease-removing function in an extremely straightforward manner, with no immediate steam exhaust from laundry drum 3, even with the fan running.

Moreover, sensor 31 safeguards against user selection and activation of drying or crease-removing cycles incompatible with the position of shutter means 30.

Without sensor 31, in fact, activation of a drying cycle with shutter means 30 in the closed position could result in overheating and damage to the laundry. Disabling of the drying cycle by control unit 14 on the basis of information from sensor 31, on the other hand, conveniently eliminates any risk of accidental damage to the fabrics inside the laundry drum.

Clearly, changes may be made to electric household appliance 1 as described herein without, however, departing from the scope of the present invention.

The invention claimed is:

1. An electric household appliance comprising a casing; a rotary drum for housing laundry to be dried and mounted for rotation about its longitudinal axis; a door which rotates to and from a work position closing an opening in said casing to close said drum; a hot-air generator for circulating hot air inside the drum; a steam generator for circulating a steam jet inside the drum; at least one exhaust manifold communicating with said drum to allow outflow of air/steam from said drum; and a shutter mechanism for selectively permitting or preventing outflow of air/steam from said drum;

wherein said exhaust manifold comprises a first manifold portion extending inside said casing and having an inlet substantially facing a lateral wall of the door; and a second manifold portion fitted to said door and designed to communicate with the inlet of said first manifold portion when said door closes said opening; said shutter mechanism being configured for selectively opening/closing said second manifold portion to permit or prevent free flow of air or steam from said drum to said first manifold portion.

2. An electric household appliance as claimed in claim 1, wherein said electric household appliance further comprises a fan located along said exhaust manifold downstream from said shutter mechanism, for generating a said outflow of air/steam from said drum when permitted by said shutter mechanism.

3. An electric household appliance as claimed in claim 1, further comprising an electric motor for rotating both the fan and said drum about respective axes.

4. An electric household appliance as claimed in claim 1, wherein said shutter mechanism is interposed between said drum and said exhaust manifold.

5. An electric household appliance as claimed in claim 1, wherein said second manifold portion comprises a shell fixed stably to said door and having a perforated wall facing said drum; said shutter mechanism comprising a shutter plate fitted to said perforated wall to move between an open position, in which air/steam flows freely from the drum to the exhaust manifold through the holes in said perforated wall, and a closed position, in which the shutter plate closes the holes in said perforated wall to prevent free outflow of air/steam from the drum through said exhaust manifold.

6. An electric household appliance as claimed in claim 1, wherein said second manifold portion comprises a shell fixed stably to said door and having a perforated wall facing said drum, and a lateral wall having a through slit communicating with the inlet of the first manifold portion; said shutter mechanism comprising a flap fitted to said lateral wall of said shell, at said slit, to move between an open position, in which air/steam flows freely from the drum into the first manifold portion through said slit, and a closed position, in which said flap seals the slit to prevent free outflow of air/steam from the drum through said first manifold portion.

7. An electric household appliance as claimed in claim 1, wherein said second manifold portion comprises a shell fitted to the inside of said door and having a perforated wall facing said drum, and a lateral wall having a through slit communicating with the inlet of the first manifold portion of the exhaust manifold; the inlet of the first manifold portion being defined by an opening formed in an annular edge of the casing housing said door; said shutter mechanism comprising a flap fitted to said annular edge to move between an open position, in which air/steam flows freely from the drum into the first manifold portion through said opening, and a closed position, in which said flap seals the opening to prevent free outflow of air/steam from the drum through the said first manifold portion.

8. An electric household appliance as claimed in claim 1, and comprising a sensor for determining the closed/open position of said shutter mechanism.

9. An electric household appliance as claimed in claim 8, and comprising a control unit for selectively enabling/disabling at least one of said hot-air generator and said steam generator as a function of the open/closed position of said shutter mechanism determined by said sensor.

10. An electric household appliance as claimed in claim 9, wherein said control unit is operative to selectively enable/ disable said hot-air generator and said steam generator as a function of the open/closed position of said shutter mechanism determined by said sensor.

11. An electric household appliance as claimed in claim 1, wherein said shutter mechanism comprises a moveable shutter plate.

12. An electric household appliance as claimed in claim 11, wherein said moveable shutter plate is a user operable manually moveable shutter plate.

13. An electric household appliance comprising a casing; a rotary drum for housing laundry to be dried and mounted for rotation about its longitudinal axis; a door which rotates to and from a work position closing an opening in said casing to close said drum; a hot-air generator for circulating hot air inside the drum; a steam generator for circulating a steam jet inside the drum; at least one exhaust manifold communicating with said drum to allow outflow of air/steam from said drum; a shutter mechanism for selectively permitting or preventing outflow of air/steam from said drum; a sensor for determining the closed/open position of said shutter mechanism; and a control unit for selectively enabling/disabling at least one of said hot-air generator and said steam generator as a function of the open/closed position of said shutter mechanism determined by said sensor.

14. An electric household appliance as claimed in claim 13, wherein said control unit is operative to selectively enable/disable said hot-air generator and said steam generator as a function of the open/closed position of said shutter mechanism determined by said sensor.

* * * * *